United States Patent [19]

Stange

[11] 4,007,982

[45] Feb. 15, 1977

[54] METHOD AND APPARATUS FOR ULTRASONICALLY CLEANING A PHOTOCONDUCTIVE SURFACE

[75] Inventor: Klaus K. Stange, Pittsford, N.Y.

[73] Assignee: Xerox Corporation, Stamford, Conn.

[22] Filed: Feb. 6, 1975

[21] Appl. No.: 547,523

[52] U.S. Cl. ..... 355/15; 15/256.53; 96/1 R; 134/1

[51] Int. Cl.[2] ..... G03G 21/00

[58] Field of Search ..... 355/15, 17; 15/256.5, 15/256.51, 256.52, 256.53; 134/1, 9; 96/1 R

[56] References Cited

UNITED STATES PATENTS

| | | | |
|---|---|---|---|
| 3,724,020 | 4/1973 | Till | 355/15 X |
| 3,741,157 | 6/1973 | Krause | 355/15 X |
| 3,848,992 | 11/1974 | Smith | 355/15 |

*Primary Examiner*—Fred L. Braun

*Attorney, Agent, or Firm*—James T. Ralabate; Clarence A. Green; Paul Weinstein

[57] ABSTRACT

A cleaning apparatus, electrostatographic machine and process are provided wherein particulate material is removed from the surface of an electrostatographic imaging member by at least one blade member having an edge engaging the surface. The blade edge is vibrated at a frequency sufficiently high to substantially reduce the frictional resistance between the blade edge and the imaging surface. The amplitude of the vibrations is controlled to a level which will insure sufficient conformity between the blade edge and the imaging surface so that adequate cleaning can be provided. Preferably the vibrations are carried out at ultrasonic frequencies with an amplitude less than about 0.005 inches.

22 Claims, 5 Drawing Figures

METHOD AND APPARATUS FOR ULTRASONICALLY CLEANING A PHOTOCONDUCTIVE SURFACE

CROSS-REFERENCE TO RELATED APPLICATION

U.S. application Ser. No. 547,522 filed Feb. 6, 1975 for a vibrating blade cleaner to Meltzer.

BACKGROUND OF THE INVENTION

This invention relates to electrostatographic imaging systems and more particularly to an improved blade cleaning apparatus for cleaning electrostatographic image developer material from an imaging surface.

One method for cleaning of electrostatographic plates is disclosed in U.S. Pat. No. 3,552,850, to Royka et al. A flexible cleaning blade is used in pressure contact at the photoconductive surface to remove residual toner particles. Royka et al. also disclose that a dry solid lubricant may be supplied to the electrostatographic plate.

It is also known to supply slow translation to the cleaning blade in an electrostatographic plate cleaning apparatus. Such translation systems are described in detail in U.S. Pat. Nos. 3,724,019 to Shanley; 3,724,020 to Till; 3,740,789 to Ticknor; 3,847,480 to Fisher; and 3,854,814 to Jones. The systems described in the Shanley, Till, and Ticknor patents are similar in many respects to those employed commercially in the Xerox 3100 and 4000 copiers. In those systems the blade is slowly moved parallel to the drum axis in a reciprocal fashion. One of the features of those systems is that the slow sideways translation of the blade distributes the wear caused by an individual drum asperity over a relative large portion of the blade edge. This consequently extends blade life and reduces the occurrence of cleaning failures. It has also been found that slow translation of the blade for a few seconds after the drum had stopped is beneficial in breaking up particle accumulation developed between the blade and the photoconductive surface, thereby providing improved cleaning.

Copiers employing blade cleaning systems can be subject to random cleaning failures which can result in undesirable print-out on the copy sheet. For example, toner streaking which can print-out can be caused by a local tuck-under or folding under of the blade edge which contacts the photoconductive surface. Toner passing under the blade edge at the tuck-under forms the streak-type failure. Lubricants are employed in the commercial copiers to reduce the occurrence of such tuck-unders. Typical lubricants useful for this purpose are described in the Royka et al. patent.

In U.S. Pat. Nos. 3,848,992, to Smith, and 3,848,993 to Hasiotis, there are disclosed cleaning blade structures for cleaning dry toner from a photoreceptor surface without lubrication other than the toner itself. The blades comprise a sharpe-edged elastomer cleaning tip which is integrally mounted on a main blade portion of much more rigid and thin material such as steel shim stock. The shim stock extends out to closely adjacent the cleaning edge of the tip to fully support it. The blade structures described in these patents are effective to provide lubricantless blade cleaning of toner while substantially reducing the occurrence of tuck-under type cleaning failures.

In accordance with this invention a blade cleaning system is provided wherein the blade is vibrated at a high frequency to reduce the blade to imaging surface friction. The approach of the present invention should provide a still further improvement by reducing and perhaps eliminating tuck-under type failures.

In U.S. Pat. No. 3,617,123 to Emerson, a method and apparatus for cleaning residual toner material is provided wherein a brush mounted at the entrance to a development-cleaning station is vibrated to uniformly distribute residual toner over the entire area of the photoconductive surface to improve cleaning. The brush itself does not remove the toner.

In U.S. Pat. No. 3,483,034, to Ensminger, a method and apparatus for cleaning residual powder particles from the surface of the xerographic plate is provided in which the surface to be cleaned is submerged in a liquid medium and subjected to a source of sonic energy therein. Vibrations are induced into the liquid medium by the source of sonic energy to produce at the plate surface a turbulent scrubbing action to remove the powder particles.

In addition to the foregoing patents, numerous patents exist in fields outside electrostatography, which deal with the use of reciprocating, oscillatory, or vibrating doctor blades. Exemplary of oscillatory systems are U.S. Pat. Nos. 2,300,908; 2,544,557; 2,857,612; 2,972,767; and 3,130,439. Exemplary of vibrating systems are U.S. Pat. Nos. 2,885,069; 3,087,184; 3,389,655; and 3,617,123. U.S. Patent No. 3,087,184 in particular shows the use of a vibrating doctor blade mechanism to provide a self-cleaning action for the blade.

In blade cleaning of toner, the toner is not being doctored, rather the toner is preferably totally stopped by the cleaning blade or blades in a single rotation of the photoreceptor drum or surface, and simultaneously or subsequently removed from the surface. The entire surface must be cleaned thousands of times without damage. The cleaning loads on the blade are very uneven, both short term and long term, because the location, density and tenacity of the residual toner varies widely over the surface, depending on the images, the exposures, the surface charges, the toner development, the image border areas, etc. Furthermore, the frictional forces of the cleaning operation, unless carefully controlled, can easily result in the generation of excessive pressure or heat, resulting in physical and chemical changes in the toner, smearing to toner materials onto the photoreceptor, or blade, excessive photoreceptor wear, or other problems, especially in higher speed machines. Thus, cleaning dry toner from a photoreceptor presents extremely critical requirements not normally found in other cleaning fields and applications, e.g., cleaning or doctoring systems for metal gravure rollers or inking rollers or paper mill roller or adhesive applicators, are not normally appropriate.

SUMMARY OF THE INVENTION

This invention relates to a cleaning system for cleaning residual particulate material from the surface of an electrostatographic imaging member. The cleaning system includes at least one blade-like element having a cleaning edge adapted to bear against the surface of the imaging member. Means are provided for vibrating the blade in a direction parallel to the imaging surface at a sufficiently high frequency to substantially reduce the friction between the blade edge and the imaging surface. The amplitude of the vibrations at the blade edge is controlled to insure proper conformity between the blade edge and the imaging surface.

Preferably the blade is vibrated at ultrasonic frequencies greater than 10 kilohertz and more preferably greater than 20 kilohertz. The amplitude of the vibrations at the blade edge preferably is limited to an amount less than 0.005 inches and more preferably less than 0.003 inches. Preferably the blade is made from metal with only the very tip made from a resilient material to reduce abrasion of the photoconductive surface.

In accordance with this invention a process is also provided for removing residual particulate material from an electrostatic imaging surface which includes the step of vibrating a cleaning blade having an edge bearing upon the imaging surface at a frequency sufficient to substantially reduce the friction between the blade edge and the imaging surface. The process further includes controlling the amplitude of the vibrations at the blade edge during vibration to a value at which the blade edge can conform sufficiently to the imaging surface to provide adequate cleaning. The preferred frequencies and amplitudes for the vibration and amplitude control steps are the same as those set forth above.

An electrostatographic reproducing machine employing the above-noted blade cleaning apparatuses also forms a part of this invention.

It is accordingly an object of the present invention to provide a new and improved blade cleaning apparatus and electrostatographic reproducing machine.

It is another object of the present invention to provide a blade cleaning apparatus and process employing high frequency vibration for improved cleaning.

It is a further object of the present invention to provide a blade cleaning apparatus and process wherein the frictional engagement between the blade cleaning member and the imaging surface is substantially reduced.

It is a still further object of the present invention to provide a vibrating blade cleaning apparatus and process wherein the blade is vibrated at ultrasonic frequencies.

Other objects and features of the present invention will become apparent by reference to the following description and drawings, while the scope of the invention will be pointed out in the appended claims.

DETAILED DESCRIPTION

Figure 1:
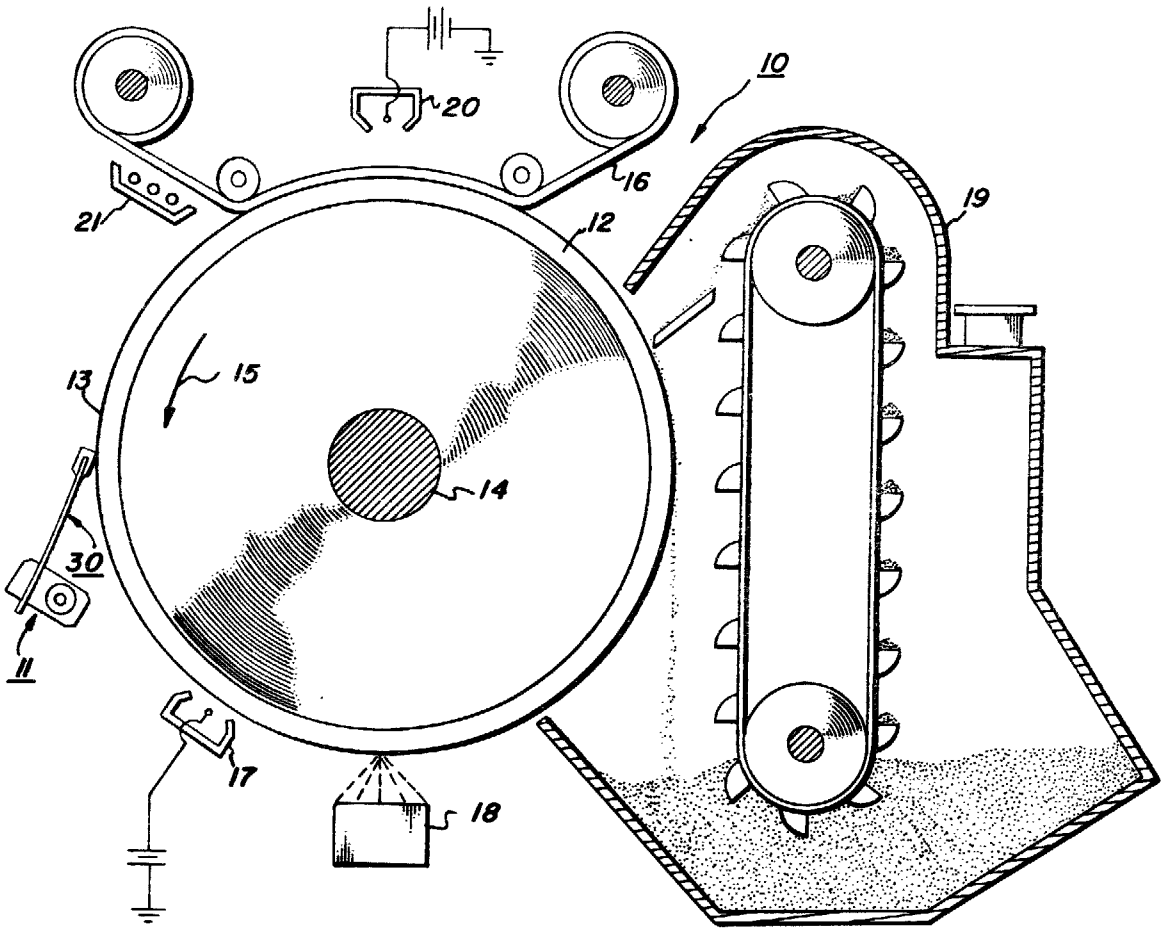
FIG. 1 illustrates a schematic representation of a reproducing machine and vibrating blade cleaning apparatus of the present invention.

Referring now to FIG. 1, there is shown by way of example an automatic xeerographic reproducing machine 10 which incorporates the cleaning apparatus 11 of the present invention. The reproducing machine 10 depicted in FIG. 1 illustrates the various components utilized therein for producing copies from an original document. Although the cleaning apparatus 11 of the present invention is particularly well adapted for use in an automatic xerographic reproducing machine 10, it should become evident from the following desription that it is equally well suited for use in a wide variety of electrostatographic systems and it is not necessarily limited in its application to the particular embodiment or embodiments shown herein.

The reproducing machine 10 illustrated in FIG. 1 employs an image recording drum-like member 12, the outer periphery of which is coated with a suitable photoconductive material 13. One type of suitable photoconductive material is disclosed in U.S. Pat. No. 2,970,906, issued to Bixby in 1961. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproduction of the original input scene information is recorded upon a web or sheet or final support material 16 such as paper or the like.

The practice of xerography is well known in the art and is the subject of numerous patents and texts including *Electrophotography* by Schaffert, published in 1965, and *Xerography and Related Processes* by Dessauer and Clark, published in 1965.

Initially, the drum 12 moves the photoconductive surface 13 through a charging station 17. At the charging station, an electrostatic charge is placed uniformly over the photoconductive surface 13 preparatory to imaging. The charging may be provided by a corona generating device of the type described in U.S. Pat. No. 2,836,725, issued to Vyverberg in 1958.

Thereafter, the drum 12 is rotated to exposure station 18 wherein the charged photoconductive surface 13 is exposed to a light image of the original input scene information whereby the charge is selectively dissipated in the light exposed regions to record the original input scene in the form of a latent electrostatic image. A suitable exposure system may be of a type described in U.S. Pat. No. 3,062,110, issued to Shepardson et al. in 1962. After exposure, drum 12 rotates the electrostatic latent image recorded on the photoconductive surface 13 to development station 19 wherein a conventional developer mix including toner particles is cascaded over the photoconductive surface 13 rendering the latent image visible as a toner defined image.

The developed image on the photoconductive surface 13 is then brought into contact with web 16 of final support material within a transfer station 20 and the toner image is transferred from the photoconductive surface 13 to the contacting side of the web 16. The final support material may be paper, plastic, etc., as desired.

After the toner image has been transferred to the final support material 16 the web within the image thereon is advanced to a suitable fuser 21 which coalesces the transferred powder image thereto. One type of suitable fuser is described in U.S. Pat. No. 2,701,765, issued to Codichini et al. in 1955. After the fusing process the web 16 is advanced to a suitable output device.

Although a preponderance of the toner powder is transferred to the final support material 16, invariably some residual toner remains on the photoconductive surface 13 after the transfer of the toner powder image to the final support material. The residual toner particles remaining on the photoconductive surface 13 after the transfer operation are removed therefrom as the drum moves through the cleaning station 11. The toner particles are mechanically cleaned from the photoconductive surface 13 by the use of a high frequency vibrating blade as will be set forth in greater detail hereafter.

It is believed that the foregoing description is sufficient for purposes of the present application to illustrate the general operation of an automatic xerographic copier 10 which can embody the cleaning apparatus 11 in accordance with the present invention.

The drum cleaning station 11 is positioned downstream from the transfer station 20 and upstream of the charging station 17. If desired, the removed toner can be returned for reuse to the developer station 19 by a suitable conveyor system as described in U.S. Pat. No. 3,678,896, issued to Hewitt.

Figure 2:
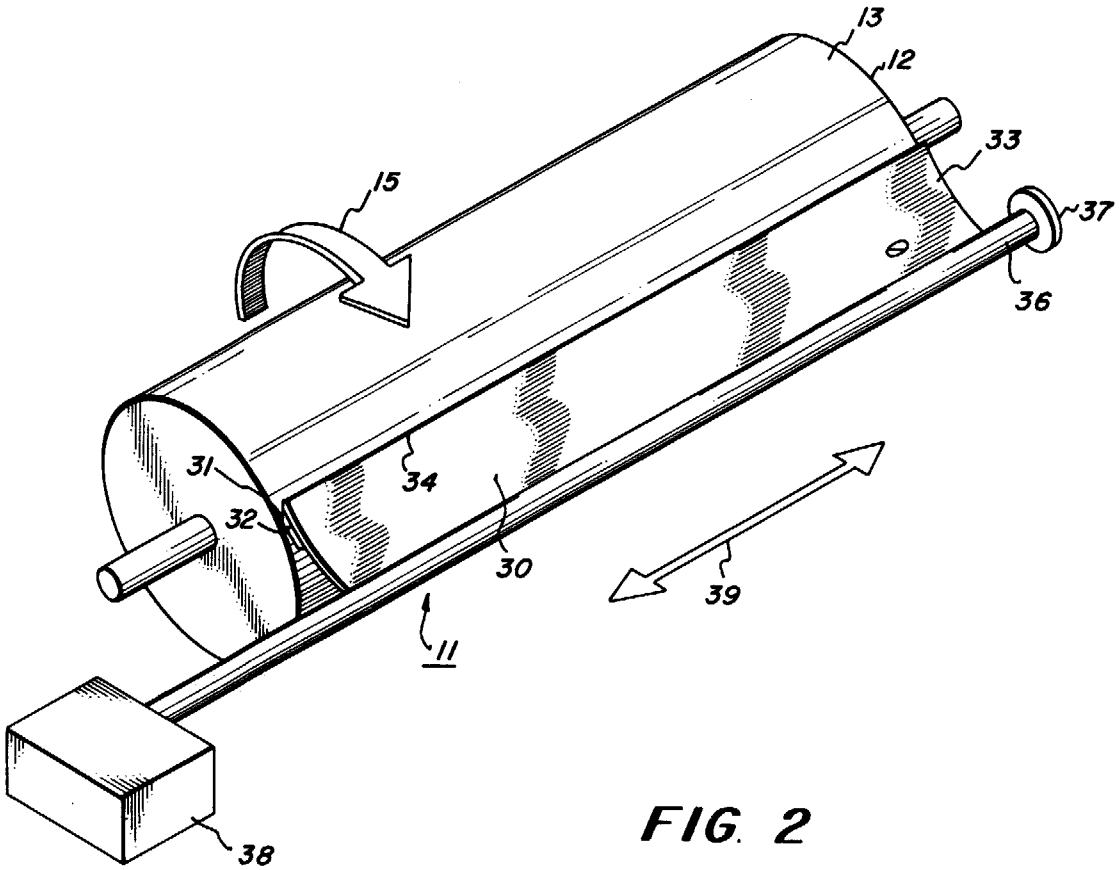
FIG. 2 is a perspective view of a cleaning apparatus in accordance with this invention.

Referring now to FIG. 2, the elements of the cleaning apparatus 11 shown comprise a cleaning blade member 30 having a cleaning edge 31 for engaging the imaging surface 13 of the drum 12. The cleaning blade structure shown is similar in many respects to that described in the aforenoted U.S. Pat. No. 3,848,992 to Smith. The cleaning blade member 30 comprises an elastomer cleaning tip portion 32 mounted to the outer edge of a main blade portion 33 for resiliently engaging and cleaning the photoconductive surface 13. The main blade portion 33 is a continuous sheet of substantially inelastic, thin, planar material preferably sheet metal or metal shim stock. The main blade portion 33 is in the form of a continuous generally rectangular bladelike member extending in length sufficiently to clean the entire axial width of the photoconductive surface. It has opposing parallel spaced edges 34 and 35. The mounting edge 35 is adapted to be clamped to the blade carrier rod 36. Preferably the carrier rod 36 and clamp extend uniformly and continuously along the mounting edge 35 of the main blade portion 33. The opposing free edge 34 of the main portion continuously supports the much smaller elastomer containing tip portion 32 which extends evenly therealong.

It is preferred, in accordance with this invention, to maintain the thickness of the tip portion, namely, the thickness between the cleaning edge 31 and the main blade portion 33 as small as possible, preferably from about 0.020 to about 0.030 inches. The maximum thickness of the elastomer tip which can be used is, of course, governed by the damping effect of the elastomer material on the ultrasonic vibrations applied. Elastomer blades similar to those utilized commercially, as described above, are too thick and insufficiently supported to be utilized with a vibrating blade cleaner operating at high frequencies as in this invention. The vibrations applied would be readily damped out by the resilient blade material so that the cleaning edge of the blade might not vibrate at all. Therefore, the use of a supported blade structure, as described above, is highly desirable to assure that the vibratory motion required in accordance with this invention is transmitted to the cleaning edge 31 of the blade member 30. The thickness of the main portion 33 of the blade member 30 is preferably only a few mills.

The blade member 30 is mounted in cantilever fashion to the blade carrier rod 36. It is noted that only the main portion 33 of the blade member is secured thereto, and there is no clamping engagement whatsoever with any of the elastomer cleaning tip 32 material. The elastomer cleaning tip 32 is spaced from the carrier rod 36 by the entire unsupported width of the main portion 33. Further details with respect to the blade member 30 may be found by reference to the aforenoted Smith and Hasiotis patents.

The tip portion 32 may be comprised of any suitable flexible material, for example, polyurethane. Preferably the tip material should be relatively soft to prevent or minimize abrasion, scouring, scratching, etc., of the photoconductive surface, and yet allow effective cleaning of the surface. Suitable materials include polysiloxane rubber, polyurethane foam or rubber, polytetrafluoroethylene resin, polytrifluorochloroethylene resin, styrene butadiene rubber, nibile-silicone rubber, polyethylene resin and blends, mixtures and copolymers thereof.

The blade member is mounted for reciprocating movement in the direction shown by the arrow 39. The blade carrier rod is mounted for such reciprocating movement though the use of flexure bearings 37 or diaphragms made of a suitably thin spring-like material which will not damp out the vibrations applied to the carrier rod in the direction of arrow 39. High frequency vibratory motion is applied to the blade carrier 36 and thereby to the cleaning edge 31 of the blade by connecting one end of the carrier 36 to a source of high frequency vibration 38.

The source of high frequency vibration 38 may be any desired source. The vibrator could comprise an ultrasonic horn excited by a piezoelectric crystal in a conventional fashion. It could comprise a voice coil or other similar moving coil type device such as conventionally employed in audio type speaker systems and excited by a suitable high frequency current signal. Still other sources of high frequency vibration such as fluid actuated devices could be used.

In accordance with this invention, it is preferred to employ a moving coil 38 type source. A moving coil device allows great latitude in selecting frequency, vibrational amplitude and the profile of the vibrations. For example, the moving coil can be excited by signals having any desired shape such as saw-tooth, sinusoidal, or square wave.

By driving the moving coil 38 in a push pull mode at a desired frequency and amplitude, the coil, the carrier rod 36, and the blade member 30 will move at about the desired frequency. The blade edge 31 will also traverse the surface of the drum 12 at about the desired frequency, but obviously with a reduced vibrational amplitude due to the resiliency of the material of which the tip is made.

The vibrational frequency provided at the blade edge 31 by the source 38 should at the minimum be sufficiently high to substantially reduce friction between the cleaning edge and the imaging surface 13. Preferably, ultrasonic frequencies should be employed of at least about 10 – 20 kilohertz. Excitation levels above 15 kilohertz are desirable since they would be above the normal range of human bearing.

It is believed to be important in accordance with this invention to control the amplitude of the vibrations at the blade edge 31 to an amount which will not cause cleaning failure due to non-conformity of the blade edge 31 to the imaging surface 13. Preferably, the vibrational amplitude at the blade edge 31 should be less than about 0.005 inches, for example, from about 0.002 to about 0.005 inches. Preferably the vibrational amplitude is less than 0.003 inches.

The amplitude of the vibrations at the blade edge 31 must be controlled in order to insure proper conformity between the blade edge and the surface 13 of the imaging member 12. The imaging surface 13, while appearing smooth, actually has a certain degree of roughness on a microscopic scale. On such a scale the surface would be comprised of alternating hills and valleys. For example, a peak-to-peak distance for a typical photoconductive drum might be on the order of about 0.004 inches. If the blade edge 31 is not moving, or if it is moving relatively slowly, the resilient material of the edge is allowed to sufficiently conform to the hills and valleys to provide proper cleaning. However, if the blade edge 31 is vibrated at a very high frequency with an amplitude which is substantially greater than the distance between peaks, the resilient edge material does not have time to conform to the surface of the drum and it is expected that poor cleaning and unnecessary blade wear would result. When a blade in accordance with this invention was vibrated at a 300 hertz frequency with an amplitude of 0.01 to 0.03 inches, cleaning failures resulted. If the imaging surface could be provided with a smoother finish, such as are found on the surface of magnetic recording drums for computer memory application, then somewhat greater amplitudes of vibration than as set forth above might be acceptable.

Therefore, in accordance with this invention, high frequency vibrations are applied to the cleaning ede 31 of the blade member 30 to reduce the frictional resistance between the cleaning edge and the imaging surface 13. However, at the same time, the vibrational amplitude at the blade edge is strictly controlled to provide proper conformity between the edge and the imaging surface 13.

It has been found in accordance with this invention that in order to vibrate at high frequencies over very short strokes, it is necessary to reduce the mass which is vibrated to as small as possible. The use of a blade structure, as described above, is effective insubstantially reducing the mass of the blade. Further reductions in the mass of the vibrating parts may be provided by constructing the carrier rod 36 and mounting hardware of lightweight materials such as magnesium.

Figure 3:
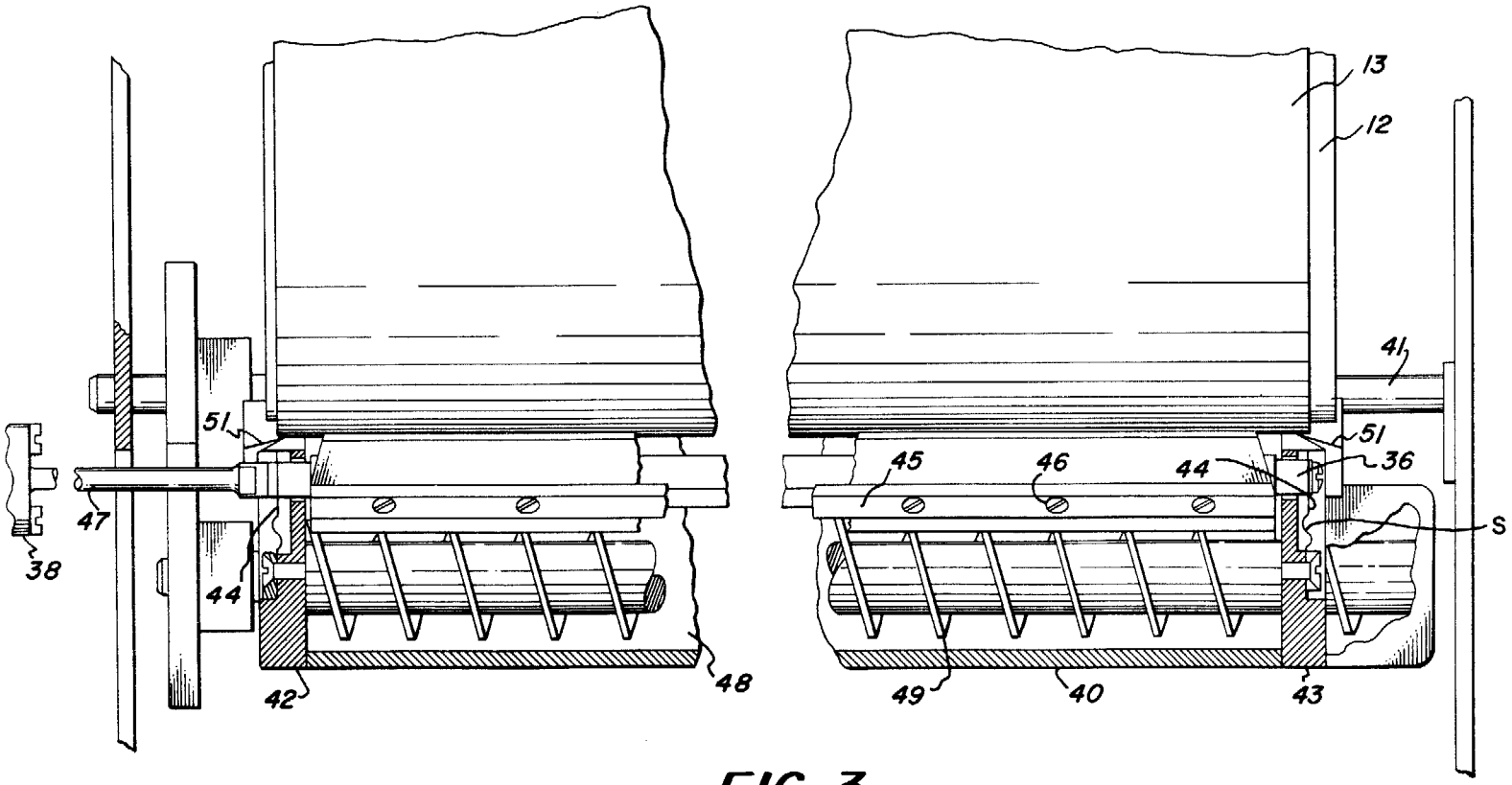
FIG. 3 is a top view in partial cross-section of a cleaning apparatus of this invention.
Figure 4:
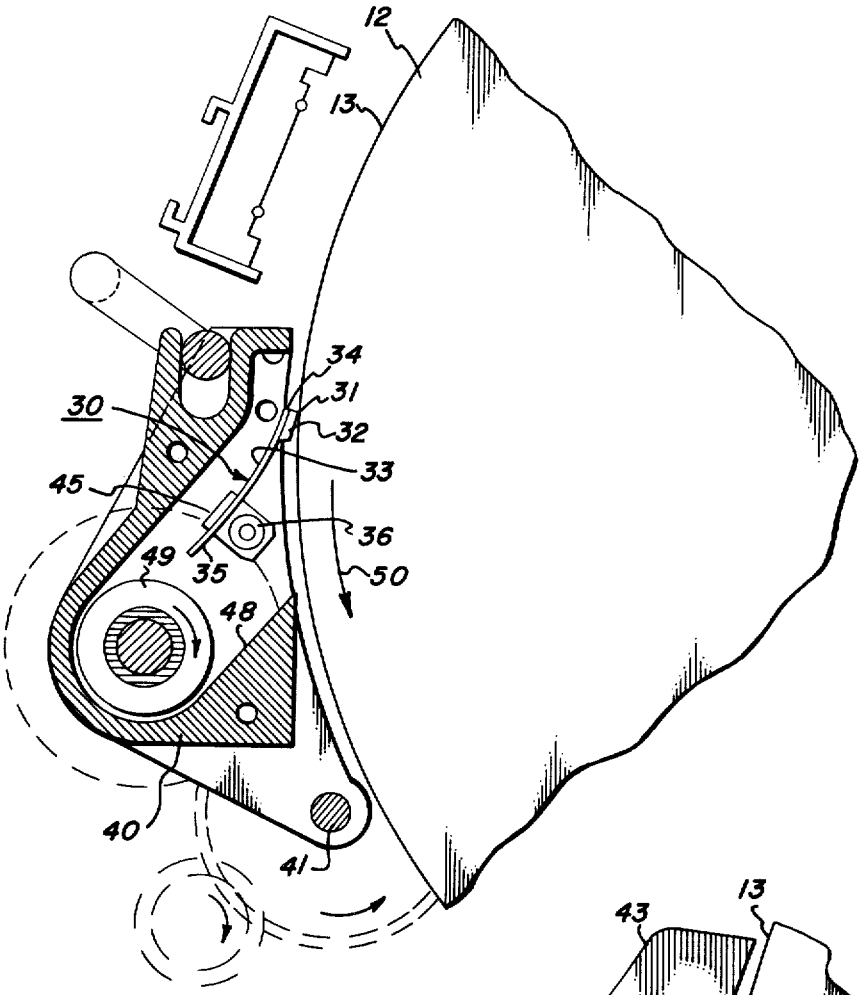
FIG. 4 is a side view in cross-section of a cleaning apparatus of this invention.
Figure 5:
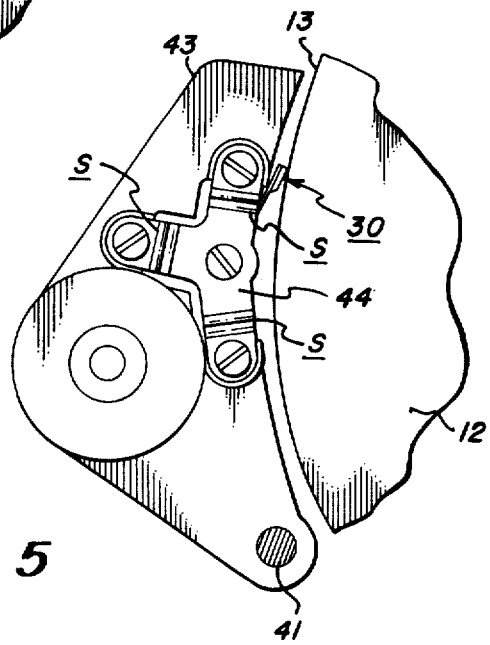
FIG. 5 is a side view of the cleaning apparatus of the present invention.

Having thus described the principal and operation of a vibrating blade cleaning apparatus 11, in accordance with this invention, reference is now had to FIGS. 3 through 5 illustrating the application of such a device in a more detailed fashion. The cleaning apparatus of this invention shown in FIGS. 3 through 5 is adapted for insertion in place of the cleaning system conventionally used in a Xerox 4000 copier.

The apparatus includes a support housing 40 mounted about shaft 41 for pivotal movement toward and away from the surface 13 of the photoconductor drum 12. The support housing 40 includes side plates 42 and 43 at opposing ends of the housing. The blade carrier rod 36 is supported between the ends of the housing by means of T-shaped flexure bearings 44 secured to the side plates 52 and 43 and the carrier rod. The main portion 33 or shim portion of the blade 30 is secured to the blade carrier rod by means of a clamping member 45 and screws 46. The blade carrier rod 36 is supported by the flexure bearings 44 for reciprocating movement in a direction parallel to the surface 13 of the drum and transverse and preferably generally normal to the direction in which the drum is rotating as shown by arrow 50. The flexure bearings 44 comprise thin, spring-like members. They support the blade carrier rod 36 so that the blade member 30 is supported cantilever fashion with the cleaning edge 31 of the blade engaging the surface 13 of the drum with sufficient normal force to effect proper cleaning. The flexure bearing 44 shown have a generally T-shaped configuration. The edges of each of the three legs of the bearings are secured to the respective side plate 42 or 43. The blade carrier rod 36 is secured to a central portion of the bearings. An "S" shaped convolution S is provided in each of the legs of the bearing 44 to provide the necessary flexibility for the reciprocating motion of the carrier 36.

The degree of cantilever loading of the blade edge 31 is, therefore, adjustable by rotating the blade carrier rod with respect to the flexure bearings 44 until the desired degree of cantilever loading has been applied and then locking the carrier rod to the flexure member by means of the screws shown. Further refinement of the blade loading can be obtained by adjusting about the pivot 41 the relative position of the cleaning housing 40 with respect to the surface 13 of the drum 10. Skew between the cleaning edge 31 of the blade and the drum surface 13 may be adjusted out by loosening the clamping plate 45 holding the blade to the carrier rod 36, and repositioning and clamping the blade to eliminate the skew.

Provision has been made at one end of the blade carrier rod 36 for securing a push rod 47 thereto connecting the blade carrier rod to the source 38 of high frequency vibrations, such as the moving coil device shown. By exciting the moving coil device with a suitable high frequency current signal from a conventional high frequency current generator, the blade 30 is caused to vibrate at high frequencies in a direction parllel to the imaging surface.

Particulate material such as toner removed by the blade falls down the backside of the blade into a trough 48. An auger 49 is provided in the trough for transporting the removed toner to an end of the cleaning housing 40 from which it can be transported away by any desirable means to a storage sump or for reuse in accordance with practices well known in the art.

Flexible seals 51 are provided at the end of the cleaning housing 40 to seal the housing with respect to the ends of the drum to prevent toner or other particulate material removed from the drum surface from contaminating the machine evironment.

The vibratory motion of the blade 30 has been described as generally parallel to the imaging surface drum axis and transverse, and preferably normal to the general direction in which the imaging surface is moved past the blade. It is not intended that the vibratory action of the blade 30 include a normal component toward and away from the drum surface, although it is possible that such a component or vibration might be inherent in the arrangement described herein. The vibratory movement of the blade edge 31 toward and away from the imaging surface 13 is thought to be undesirable because toner particles have a very small size, on the order of 20 microns and, therefore, they might get past the blade without being removed. It is preferred in accordance with this invention that the blade be maintained continuously in engagement with the imaging surface 13 during cleaning.

The normal imaging or working width of the drum surface 13 is somewhat less than the overall width of the drum 12. Therefore, the effective length of the blade 30 is preferably equal to the working width of the drum plus an amount in excess of the stroke of the blade movement which will assure effective cleaning of the entire working width of the drum 12.

The moving coil device 38, in accordance with this invention comprises a coil mechanically connected to the blade carrier 36, and electrically connected to a source of high frequency current. The coil is placed in a constant magnetic field, such as provided by a permanent magnet. The current through the coil interacts with the magnetic field causing the coil and blade carrier rod to move back and forth in time with the current variations through the coil. The frequency of the vibrations is determined by the frequency of the current applied to the coil and the amplitude of the magnitude of the current.

The vibrating blade apparatus of this invention can be used with a lubricant as described in the aforenoted Royka patent, if desired.

The patents and texts referred to specifically in this application are intended to be incorporated by reference into the application.

It is apparent that there has been provided in accordance with this invention a high frequency cleaning apparatus, process and reproducing apparatus which fully satisfies the objects, means and advantages set forth hereinbefore. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A cleaning appratus for removing particulate material from an imaging surface of an electrostatographic imaging member which is arranged for movement in a desired direction, said apparatus comprising:

means for removing said particles from said surface, said removing means comprising at least one blade member having an edge engaging said surface, said blade member extending across said surface; and means for vibrating said blade member in a direction substantially parallel to said surface and transverse to the direction in which said imaging surface is movable and at an ultrasonic frequency which is sufficiently high to substantially reduce the frictional resistance between said blade edge and said imaging surface and with a vibrational amplitude at said blade edge sufficiently small to insure sufficient conformity between said blade edge and said imaging surface for providing adequate cleaning of said particulate material therefrom.

2. An apparatus as in claim 1, wherein said frequency comprises at last about 10 kilohertz.

3. An apparatus as in claim 2, wherein the vibrational amplitude at said blade edge is less than about 0.005 inches.

4. An apparatus as in claim 3, wherein said vibrational amplitude is less than about 0.003 inches.

5. An apparatus as in claim 4, wherein said blade member is comprised of a main portion and an elastomer tip portion, said tip portion including said cleaning edge, said main blade portion comprising a continuous sheet of substantially inelastic, thin, planar material, said apparatus further including first means for supporting said main portion in cantilever fashion so that said cleaning edge engages said imaging surface, and second means for supporting said first means for reciprocating movement parallel to said imaging surface.

6. An apparatus as in claim 5, wherein said vibrating means comprises a source of ultrasonic frequency vibrations and means for connecting said source to said first support means.

7. An apparatus as in claim 6, wherein said vibration source comprises a moving coil device and a means for exciting said moving coil comprising a source of high frequency alternating current.

8. An apparatus as in claim 7, wherein said first support means comprises a blade carrier rod and means for clamping said blade to said rod, and wherein said second support means comprises flexure bearings secured to said rod, said bearings including convolutions which allow reciprocating movement parallel to said imaging surface while preventing rotation of said carrier rod.

9. In an electrostatographic reproducing machine including means for forming an image on a sheet of final support material, said imaging means including an imaging member having an imaging surface arranged for movement in a desired direction, and means for removing particulate material from the surface of said imaging member, the improvement wherein, said removing means comprises:

at least one blade member having an edge engaging said imaging surface, said blade member extending across said surface; and means for vibrating said blade member in a direction substantially parallel to said surface and transverse to the direction in which said imaging surface is movable and at an ultrasonic frequency which is sufficiently high to substantially reduce the frictional resistance between said blade edge and said imaging surface and with a vibrational amplitude at said blade edge sufficiently small to insure sufficient conformity between said blade edge and said imaging surface for providing adequate cleaning of said particulate material therefrom.

10. An apparatus as in claim 9, wherein said frequency comprises at least about 10 kilohertz.

11. An apparatus as in claim 10, wherein the vibrational amplitude at said blade edge is less than about 0.005 inches.

12. An apparatus as in claim 11, wherein said vibrational amplitude is less than about 0.003 inches.

13. An apparatus as in claim 12, further including: means for forming an electrostatic image on said imaging surface; means for developing said electrostatic image to render it visible; and means for transferring said visible image to a sheet of final support material.

14. An apparatus as in claim 12, wherein said blade member is comprised of a main portion and an elastomer tip portion, said tip portion including said cleaning edge, said main blade portion comprising a continuous sheet of substantially inelastic, thin, planar material, said apparatus further including first means for supporting said main portion in cantilever fashion so that said cleaning edge engages said imaging surface, and second means for supporting said first means for reciprocating movement parallel to said imaging surface.

15. An apparatus as in claim 14, wherein said vibrating means comprises a source of ultrasonic frequency vibrations and means for connecting said source to said first support means.

16. An apparatus as in claim 15, wherein said vibration source comprises a moving coil device and a means for exciting said moving coil comprising a source of high frequency alternating current.

17. An apparatus as in claim 16, wherein said first support means comprises a blade carrier rod and means for clamping said blade to said rod, and wherein said second support means comprises flexure bearings secured to said rod, said bearings including convolutions which allow reciprocating movement parallel to said imaging surface while preventing rotation of said carrier rod.

18. A process for removing residual particulate material from an imaging surface of an electrostatographic imaging member, said process comprising the steps of:

engaging said surface with an edge of at least one blade member;

providing relative movement between said imaging surface and said blade edge; and vibrating said edge of said blade member in a direction substantially parallel to said surface and transverse to the direction of relative movment between said blade edge and said imaging surface and at an ultrasonic frequency which is sufficiently high to substantially reduce the frictional resistance between said blade edge and said imaging surface and with a vibrational amplitude at said blade edge sufficiently small to insure conformity between said blade edge and said imaging surface for providing adequate cleaning of particulate material therefrom.

19. A process as in claim 18, wherein said vibration step is carried out at a frequency of at last about 10 kilohertz.

20. A process as in claim 19, wherein the vibrational amplitude at said blade edge during said vibration step is less than about 0.005 inches.

21. A process as in claim 20, wherein said vibrational amplitude is less than about 0.003 inches.

22. The process as in claim 21, further including the steps of forming an electrostatic image on said imaging surface, developing said electrostatic image to render it visible, and transferring said visible image to a sheet of final support material prior to said removal of said residual particulate material.

* * * * *